US008132599B2

(12) United States Patent
Crandell et al.

(10) Patent No.: US 8,132,599 B2
(45) Date of Patent: Mar. 13, 2012

(54) AUTOMATED BALLOON INFLATOR SYSTEM

(75) Inventors: Rodney Crandell, Phoenix, AZ (US); Raymond Crandell, Phoenix, AZ (US)

(73) Assignee: Conray, Inc., Phoenix, AZ (US)

( * ) Notice: Subject to any disclaimer, the term of this patent is extended or adjusted under 35 U.S.C. 154(b) by 386 days.

(21) Appl. No.: 12/399,602

(22) Filed: Mar. 6, 2009

(65) Prior Publication Data

US 2009/0223568 A1 Sep. 10, 2009

Related U.S. Application Data

(60) Provisional application No. 61/034,943, filed on Mar. 7, 2008.

(51) Int. Cl.
*B65B 1/04* (2006.01)
*B65B 31/04* (2006.01)

(52) U.S. Cl. ..... 141/114; 141/313; 141/181; 141/198

(58) Field of Classification Search ..... 141/114, 141/165, 167, 181, 190, 198, 227, 263, 313, 141/374, 168, 10, 83, 95, 96, 197, 46; 446/220; 137/39

See application file for complete search history.

(56) References Cited

U.S. PATENT DOCUMENTS

| | | | | |
|---|---|---|---|---|
| 3,380,490 | A * | 4/1968 | Ellenberg et al. | 141/167 |
| 3,536,110 | A * | 10/1970 | West | 141/137 |
| 3,911,974 | A * | 10/1975 | Kuykendall | 141/94 |
| 5,370,161 | A * | 12/1994 | Shafer | 141/114 |
| 6,478,057 | B1 * | 11/2002 | Bearss et al. | 141/313 |
| 6,892,770 | B2 * | 5/2005 | Ratermann | 141/114 |

* cited by examiner

*Primary Examiner* — Timothy L Maust
*Assistant Examiner* — Timothy Kelly
(74) *Attorney, Agent, or Firm* — Etherton Law Group, LLC; Sandra L. Etherton; Benjamin D. Tietgen

(57) ABSTRACT

An automated system for inflating balloons. A balloon inflator comprises an electronic control system that activates the pressurized gas source to inflate a balloon. The balloons are fed through the inflator on a belt and, at the appropriate time as governed by the electronic control system, pressurized gas is emitted into a balloon. Once the balloon bursts or is removed from the inflator, the belt is advanced and that the next balloon is inflated. In the preferred embodiment, the system comprises multiple inflators and the electronic control system is operated remotely using radio frequency signals.

4 Claims, 4 Drawing Sheets

AUTOMATED BALLOON INFLATOR SYSTEM

CROSS-REFERENCE TO RELATED APPLICATIONS

This application claims the benefit of co-pending provisional application No. 61/034,943 filed Mar. 7, 2008.

FIELD OF INVENTION

This invention relates generally to devices for inflating balloons. This invention relates more specifically to automated devices for inflating balloons which are operable with remote control.

BACKGROUND

Cowboy mounted shooting has become one of the fastest growing equestrian sports in the country. Blending such disciplines as reining, barrel racing, and horsemanship, the sport of mounted shooting requires teamwork between contestant and horse. Inflated balloons are mounted as targets on top of bases of various sorts, conventionally traffic cones or 55-gallon drums. Using two .45 caliber revolvers and blank ammunition, each contestant rides through the course and shoots at the balloons; the hot powder from the gun bursts the balloons when a shot is aimed properly. The contestant tries to accurately shoot 10 balloon targets set in one of over 75 various patterns on a course while controlling his or her horses' speed and direction. Scores are based on how many balloons were successfully burst and the time it took to complete the course. The sport has over 60 courses of varying difficulties.

After each competitor has completed the course, human volunteers run onto the course and replace the burst balloons on the bases. There is significant time and effort involved to take a balloon to each of the bases and attach it prior to each contestant's run. One of the limitations for the number of contestants who can compete in one day is the time required to set the balloons on the barrels between the contestants. Another consideration is the safety of the balloon setters, who need to clear the course before a racing horse takes to the course. It would be desirable to be able to quickly replace all the burst balloons between contestants. It would also be desirable to replace the balloons without having people run onto the course between contestants.

In addition to cowboy mounted shooting, many other events need to have a large number of balloons inflated. Conventionally, to inflate a large number of balloons, the lip of each balloon is manually seated over a nozzle of a pressurized gas source and held in place by hand until the balloon is full. Then the balloon is removed and a knot tied in its neck to seal the balloon. It can be tricky to seat the lip of the limp, uninflated balloon properly over the nozzle. This causes some inefficiency as it becomes necessary to re-seat balloons before they are inflated. It would be desirable to provide an automated feeding mechanism for inflating balloons.

Therefore, it is an object of this invention to provide a device that enables balloons to be quickly replaced on the bases for cowboy mounted shooting. It is another object to place balloons on courses without having to have people run on the course. It is a further object of this invention to provide an automated feeding mechanism for inflating balloons.

SUMMARY OF THE INVENTION

This invention is an automated system for inflating balloons. A balloon inflator employs an electronic control system that activates the pressurized gas source to inflate a balloon. Balloons are automatically fed to the inflator via a belt and, at the appropriate time as governed by the electronic control system, pressurized gas is emitted into a balloon. Once the balloon bursts or is removed from the inflator, the belt can be advanced and the next balloon is inflated. In the preferred embodiment, the system comprises multiple inflators and the electronic control system is operated remotely using radio frequency signals.

DETAILED DESCRIPTION OF THE INVENTION

Figure 1:
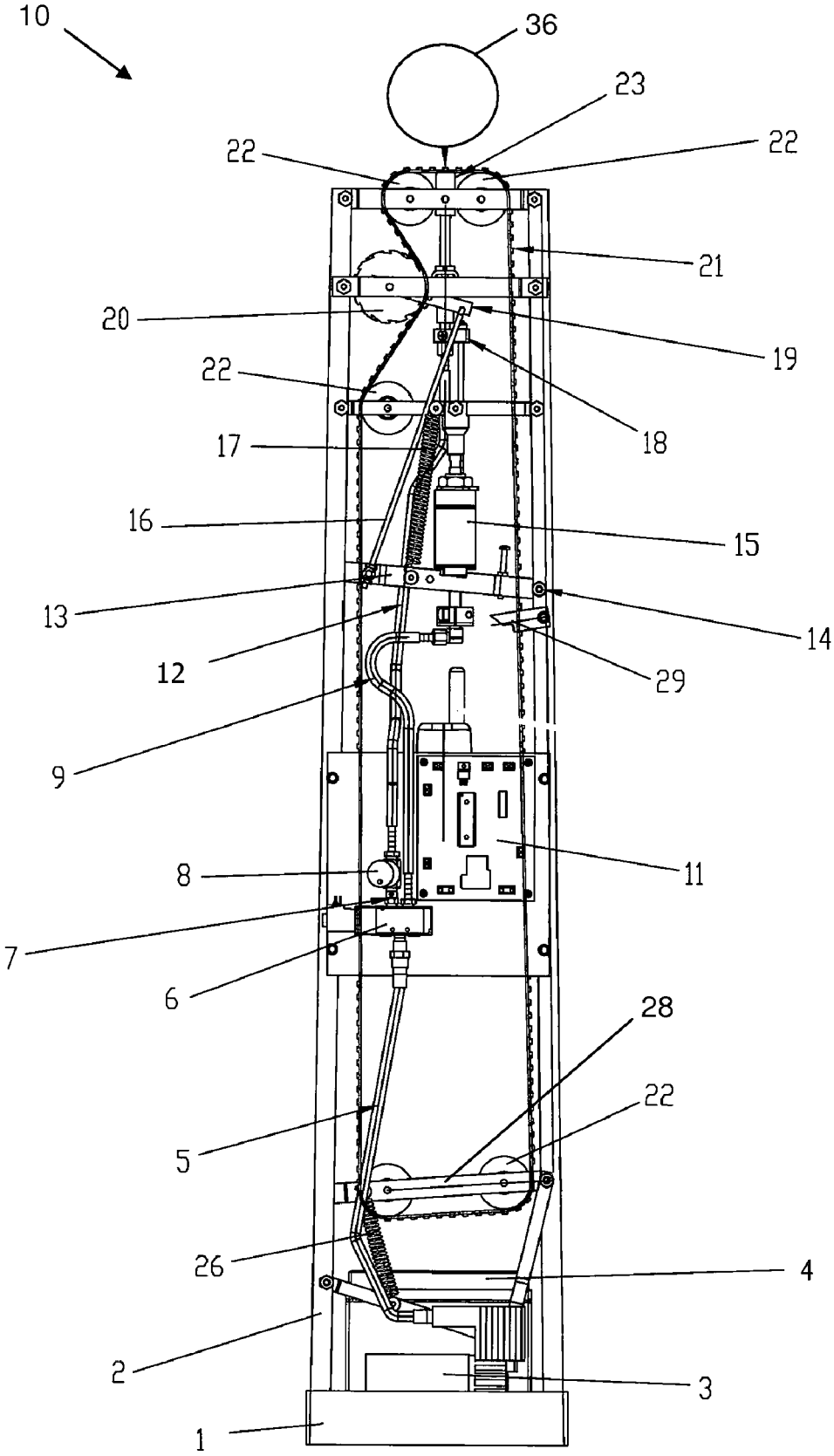
FIG. 1 is a side view of the preferred embodiment of a balloon inflator without its cover.

The present invention is an automated balloon inflator system. The system comprises generally an inflator 10 and a communication device 33 that instructs the inflator to inflate a balloon to a predetermined size. The inflator employs a collection of components that cooperate to repeatedly advance a balloon into a position to be inflated, inflate the balloon, and once the balloon bursts or is otherwise removed from the inflation position, advance the next balloon into place. Balloons can be advanced automatically or on command, either by remote control or at the inflator.

The inflator 10 components include a frame 2, a loading belt 21, a belt advancement assembly, a balloon seal block 23, an actuator 15 for moving the seal block, a pressurized gas source 3, a power source 4, and an electronic control system, each of which is explained in more detail below.

The frame 2 of the inflator serves to structurally collect all the inflator components. The preferred embodiment of the inflator is used for cowboy mounted shooting and thus its frame is preferably oriented vertically, as shown in FIG. 1, so as to allow horses to maneuver around the bases as they would around barrels. It is also preferably heavier at the base 1 than the top, so as to provide a self-righting ability if a horse runs into it. In the preferred embodiment the entire device weighs about 31 pounds—heavy enough to withstand breezes and the occasional bump, but light enough for humans to move into various course positions without additional equipment. The frame is usually covered by a removable cover, such as a deformable or padded cowling, to protect the inflator and the horse. For other embodiments, the frame and inflator may instead be oriented horizontally, for a table-mounted version, for example.

Figure 2A:
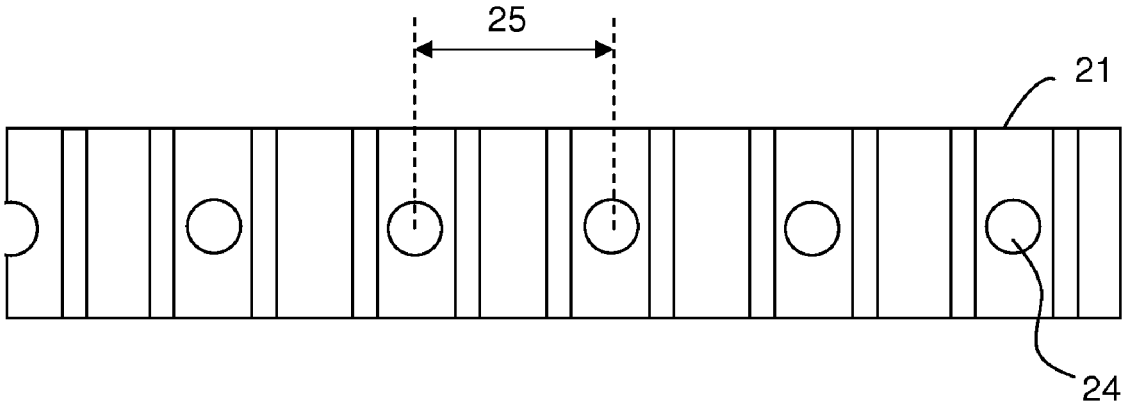
FIG. 2*a* is a top view of a part of the loading belt without balloons inserted.
Figure 2B:
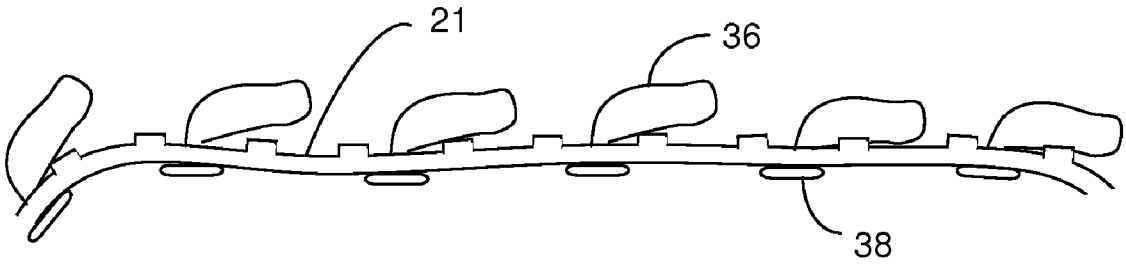
FIG. 2*b* is a side view of a part of the loading belt with balloons inserted.

The loading belt 21 is a continuous flexible pulley belt with holes 24 spaced evenly along its centerline. See FIG. 2*a*. The rolled lip 38 of each balloon 36 is inserted into a hole 24 to load the belt with balloons. FIG. 2*b* shows a portion of a loading belt loaded with balloons. In the preferred embodiment the belt holds 120 balloons, with each hole 24 spaced about 0.75 inches apart. The substantially uniform distance 25 between holes is substantially equal to the distance the belt is incremented by the belt advancement assembly. The number of holes determines how often the belt has to be changed out to reload the unit with balloons.

A belt advancement assembly moves the belt through the inflator. The advancement assembly is generally a multiple pulley system using both fixed and tensioned pulleys. Any number of pulleys can be used to provide a smooth, continuous motion. FIG. 1 shows the pulley arrangement of the preferred embodiment using five guide pulleys 22 and a gear pulley 20. Alternatively, the belt 21 can be advanced by a motor around a wheel or by other ways to advance belts, as known in the art of mechanical or electromechanical engineering. The guide pulleys 22 establish the route the belt 21 takes and cooperate with a tension bar 28 and a tension spring 26 to remain tight during operation. The guide pulleys 22 may include a groove to allow the lip 38 of each balloon to pass through the pulleys smoothly and without affecting the distance the belt 21 travels as it rotates around the pulleys. To reload the device with a belt full of uninflated balloons, the tension is loosened, the spent belt removed, a loaded belt rethreaded through the guide pulleys, and the tension retightened.

Figure 3:
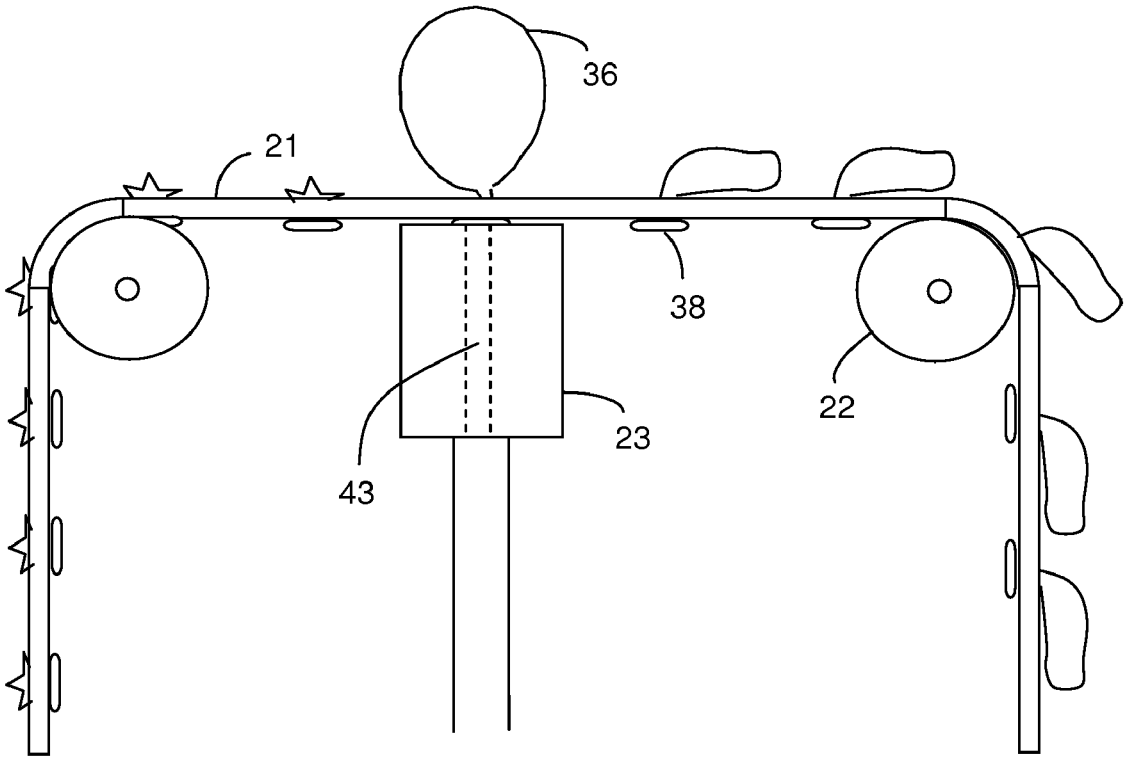
FIG. 3 is a partial side view of the loading belt being fed through the inflator.

The balloon seal block 23 and actuator 15 cooperate to position a balloon 36 for inflation. The seal block 23 has a passageway 43 for gas. See FIG. 3. As the belt 21 starts advancing the uninflated balloon towards the seal block 23, gas is emitted through the passageway 43. Simultaneously, the seal block 23 is moved by the actuator 15 toward the underside of the belt 21. Enough gas enters the balloon 36 as it moves toward its inflation position centered generally over the passageway 43 that it causes the limp balloon to slightly inflate, pulling the lip 38 tightly against the bottom of the belt 21. Subsequently, the seal block 23 is advanced firmly against the belt 21, sandwiching the lip 38 between the seal block 23 and the belt 21 to form a substantially airtight seal. This seal block configuration eliminates the need to seat the balloon over a nozzle. The relative orientation of the seal block 23, belt 21, and lip 38 cooperate to ensure the inflated balloon 36 stands substantially vertical, as opposed to leaning at various odd angles, important for ensuring consistent targets for cowboy mounted shooting. To protect the belt and uninflated balloons in the belt from flying embers during cowboy mounted shooting, a cover (not shown) may be installed over the belt. The cover may be spring loaded to cooperate with the belt and the belt advancement mechanism, such that the belt is not impeded during movement.

The pressurized gas source 3 is typically an air compressor, but may also be a canister or tank of pressurized gas such as helium. One or more air filters (not shown) may be installed to prevent dust and other contaminates from entering the compressor. In the preferred embodiment, the pressurized gas source 3 supplies about 2 cfm of air. Pressurized gas sources are typically heavy and therefore when positioned at the base 1 of the frame 2 provides a convenient weight to keep the device upright, even when bumped by a horse. Preferably, a power source 4 in the form of a battery is also mounted at the base 1 of the frame to provide additional weight and stability to the device. A computer back-up battery of 12 volts is the proper size, weight and power for the preferred embodiment of this invention. Ideally, the air compressor and battery are positioned at the base to counter balance each other if the device is bumped.

The electronic control system receives commands from the communication device 33 and controls the balloon inflation. The electronic control system can be configured in many ways, as known the electronics arts, including with discrete circuits, integrated circuits, or a combination of both. In the preferred embodiment, the electronic control system comprises a microcontroller including memory and a timer, housed on a control board 11, which sends and receives signals from an air control valve 6, an air pressure sensor 8, and a contact switch 29. The electronic control system may include the receiver of the communication device 33.

The electronic control system activates an inflation assembly which acts in coordination with the advancement mechanism to inflate the balloon. The inflation assembly is generally a system of connecting arms, lever arms, air lines, springs, and an air cylinder that produces force and movement powered by compressed gas. See FIG. 1. Upon receipt of a signal from the communication device 33, the electronic control system allows the pressurized gas source 3 to send gas through air line 5 to air control valve 6, on through air line 9 to the air cylinder 15. The pressure to builds to about 30 psi in the preferred embodiment. The air cylinder 15 then pushes down on the swing arm 13 forcing it to pivot at pivot point 14 and pull down on the pull arm 16. At the same time the cylinder 15 is pushing down on the swing arm 13, it is also pulling down on the seal plate retractor 18 to pull down on the balloon seal block 23.

The balloon seal block 23 retracts from the bottom of the belt 21 freeing the belt 21 to be advanced to the next hole 24 by the belt advancement assembly. To move the belt 21, the swing arm 13 pulls the pull arm 16, which in turn pulls on the ratcheting arm 19 to rotate the toothed gear pulley 20. The toothed gear pulley 20 turns a sufficient amount to pull the belt 21 the distance 25 to the next hole, thus establishing the timing. The toothed gear pulley may have a ratchet system that allows the pulley to rotate in only one direction. The pull arm 16 may be a cable instead of a rod, to pull the ratcheting arm 19. Springs and other components may be placed in different locations to achieve the same results, as known in the art.

When the swing arm 13 is at full stroke it activates an electrical contact switch 29 that signals the electrical control system to switch the air path through the air control valve 6 to the fill balloon 36 through the air line 12 connected to the balloon seal block 23. Once the air control valve 6 is switched, the air then travels through a check valve 7 to prevent any back flow, and passes the air pressure sensor 8 into air line 12. The air is then emitted out of the top of the balloon seal block 23 through passageway 43 before the block 23 seals to lip 38 and while the air cylinder is relaxing under tension of seal spring 17. As explained above, this partial inflation assures a proper alignment for sealing the seal block to the balloon. While the air cylinder 15 is relaxing from the removal of air pressure it is retarded in its movement by the pressurized air being released from the cylinder through the air control valve 6, which is now in its relaxed state.

While the balloon seal block 23 is sealed to the balloon and air is inflating the balloon, and the control arms are returning to their relaxed state, the electrical control system is monitoring the run time of the pressurized gas source 3 to control the size of the balloon. Settings on the electrical control system can be changed to reflect the desired size of the balloon, for example by determining how long, in seconds, the compressor 3 is set to run in order to inflate the balloon the desired amount. In other embodiments air pressure may be from an air tank, and the amount of gas released may be controlled by a valve. In yet other embodiments a pressure sensor or gas flow sensor can be employed in the electrical control system to sense when the balloon is filled the desired amount. For cowboy mounted shooting, the balloons are sized per the rule book to about 9-10 inches long and about 6 inches diameter.

The inflator 10 is operatively connected to a communication device 33 that instructs the inflator to inflate a balloon.

Figure 4:
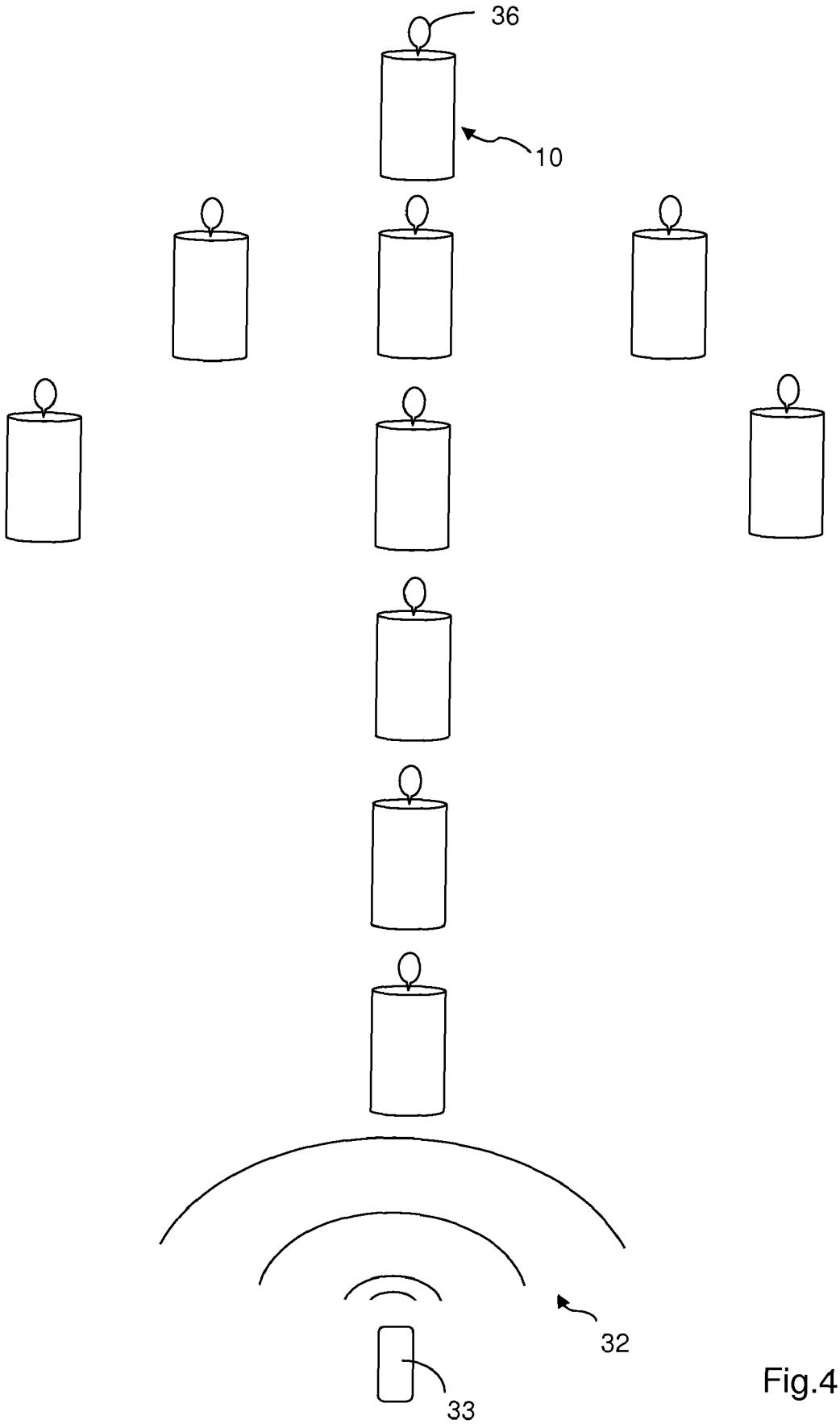
FIG. 4 is an illustration of the automated system for inflating balloons set up for a stage of cowboy mounted shooting using ten balloon inflators.

Preferably the communication device 33 is a wireless device that signals the electrical control system from a distance. See FIG. 4. Such remote control devices are well known in the art, and typically use radio frequencies 32 as the signal carrier, although infrared frequencies may be used for shorter, line-of-sight distances. The preferred embodiment uses a simple radio-frequency transmitter and receiver which are available commercially and already licensed by the FCC. Alternatively, when it is not necessary to operate the inflators from afar, the communication device 33 can be connected more directly to the inflator, for example with a foot pedal switch. This is particularly useful for inflating a large number of balloons using the table top embodiment of the inflator.

Preferably all inflators are responsive to a single communication device 33 so that one command instructs all inflators simultaneously to index the belt to the next balloon and inflate. This increases the speed at which a course can be reset with balloons for cowboy mounted shooting, which in turn increases the throughput of the number of contestants per day. For example, when balloons are reset on the course by hand, about 40 contestants can complete the course in an hour. With the present automated system, those 40 contestants can complete the course in about 18 minutes. More contestants in a shorter time means that facilities have to be rented for less time to complete the competition, and cost is reduced. More importantly, reducing the wait time between contestants creates a more exciting event for spectators.

To avoid wasting balloons that are still inflated after a course is run, each inflator can be equipped with a pressure sensor that determines by sensing back pressure whether a balloon is still inflated and, if so, will not allow the belt to be indexed. That is, while a balloon is present and above a predetermined pressure, any new inflate commands will be ignored or overridden. Preferably there is as much as a two-second delay before the inflate command can be given again. The delay is used to allow the pressure in the system from the compressor drop to zero or nearly zero. Otherwise. undesirable pulses of air can be conveyed to the seal block and dislodge the seal between the balloon and the seal block.

The system can be operatively connected to electronic score cards that indicate how many balloons each contestant successfully deflates, and also to timing sensors. Results can be posted nearly instantaneously as to the number of balloons hit and the amount of time it took to complete the course. This is not only more exciting for the spectators, but helps automate scoring.

While there has been illustrated and described what is at present considered to be the preferred embodiment of the present invention, it will be understood by those skilled in the art that various changes and modifications may be made and equivalents may be substituted for elements thereof without departing from the true scope of the invention. Therefore, it is intended that this invention not be limited to the particular embodiment disclosed, but that the invention will include all embodiments falling within the scope of the appended claims.

We claim:

1. A balloon inflator comprising:

a. a belt having holes through which balloons are inserted;

b. an advancement mechanism operatively connected to the belt;

c. a balloon seal block;

d. an actuator for causing the balloon seal block to engage the belt;

e. a pressurized gas source;

f. an electronic control system for activating the pressurized gas source to inflate a balloon;

g. a communication device operatively connected to the electronic control system, wherein upon a signal from the communication device the electronic control system:

i. advances the belt; and ii. activates the pressurized gas source; and h. a sensor that measures the gas pressure in the balloon and, if the pressure is above a pre-determined limit, overrides the signal sent from the communication device so that the belt is not advanced and the pressurized gas source is not activated.

2. A balloon inflator system comprising:

a. a first balloon inflator comprising:

i. a first belt having holes through which balloons are inserted;

ii. a first advancement mechanism operatively connected to the first belt;

iii. a first balloon seal block that is proximate to a portion of the first belt;

iv. a first actuator for moving the first balloon seal block towards or away from the first belt;

v. a first pressurized gas source;

vi. a first sensor that measures the gas pressure in a first balloon;

vii. a first electronic control system which activates the first pressurized gas source to inflate the first balloon; and b. a second balloon inflator comprising:

i. a second belt having holes through which balloons are inserted;

ii. a second advancement mechanism operatively connected to the second belt;

iii. a second balloon seal block that is proximate to a portion of the second belt;

iv. a second actuator for moving the second balloon seal block towards or away from the second belt;

v. a second pressurized gas source;

vi. a second sensor that measures the gas pressure in a second balloon;

vii. a second electronic control system which activates the second pressurized gas source to inflate the second balloon; and c. a communication device wirelessly connected to the electronic control systems of the first and second balloon inflators, wherein upon a signal from the communication device to the electronic control systems:

i. advances the belts of the first and second balloon inflators; and ii. activates the first pressurized gas source, unless the pressure of a balloon of the first balloon inflator is above a pre-determined limit, in which case the first belt of the first balloon inflator is not advanced and the first pressurized gas source of the first balloon inflator is not activated.

3. The balloon inflator system of claim 2 wherein the first pressurized gas source is a first air compressor and the second pressurized gas source is a second air compressor.

4. The balloon inflator system of claim 2 further comprising a first battery operatively connected to the first air compressor and a second battery operatively connected to the second air compressor.

* * * * *